US010907800B2

(12) United States Patent
Gostelow

(10) Patent No.: US 10,907,800 B2
(45) Date of Patent: Feb. 2, 2021

(54) TORCH

(71) Applicant: GLOWSTONE LTD, Chester (GB)

(72) Inventor: Thomas Gostelow, Chester (GB)

(73) Assignee: GLOWSTONE LTD, Cheshire (GB)

( * ) Notice: Subject to any disclaimer, the term of this patent is extended or adjusted under 35 U.S.C. 154(b) by 232 days.

(21) Appl. No.: 15/764,177

(22) PCT Filed: Sep. 23, 2016

(86) PCT No.: PCT/GB2016/052959
§ 371 (c)(1),
(2) Date: Mar. 28, 2018

(87) PCT Pub. No.: WO2017/055813
PCT Pub. Date: Apr. 6, 2017

(65) Prior Publication Data

US 2018/0299104 A1 Oct. 18, 2018

(30) Foreign Application Priority Data

Sep. 28, 2015 (GB) ..... 1517085.5

(51) Int. Cl.

| | |
|---|---|
| ***F21V 15/01*** | (2006.01) |
| ***F21L 4/00*** | (2006.01) |
| ***F21L 2/00*** | (2006.01) |
| ***F21V 15/04*** | (2006.01) |
| *F21Y 101/00* | (2016.01) |
| *F21Y 115/10* | (2016.01) |
| *F21W 131/30* | (2006.01) |

(52) U.S. Cl.
CPC ..... *F21V 15/01* (2013.01); *F21L 2/00* (2013.01); *F21L 4/00* (2013.01); *F21L 4/005* (2013.01); *F21V 15/04* (2013.01); *F21W 2131/30* (2013.01); *F21Y 2101/00* (2013.01); *F21Y 2115/10* (2016.08)

(58) Field of Classification Search
CPC .. F21V 15/01; F21V 15/04; F21L 2/00; F21L 4/00; F21L 4/005
See application file for complete search history.

(56) References Cited

U.S. PATENT DOCUMENTS 6,626,554 B2 * 9/2003 Rincover ..... F21L 4/00 362/186
2015/0309239 A1 * 10/2015 Choi ..... G02B 6/0031 349/65

* cited by examiner

*Primary Examiner* — Thomas M Sember
(74) *Attorney, Agent, or Firm* — Procopio, Cory, Hargreaves & Savitch LLP

(57) ABSTRACT

The invention concerns a torch (10) which has a rechargeable electric battery (18), at least one LED (30), an energy receiver device (16) for receiving energy from a charging station (24), circuitry for charging the battery from the energy receiver device, circuitry for supplying electric current from the battery to the LED to drive the LED, and a user-operable switching device (14) for controlling the supply of current from the battery to the LED. In accordance with the invention, the battery, the LED, the circuitry for charging the battery, the circuitry for supplying electric current from the battery to the LED and the switching device are all embedded in a unitary body of polymer material, the LED being arranged to emit light through the polymer material.

20 Claims, 7 Drawing Sheets

TORCH

CROSS-REFERENCE TO RELATED APPLICATIONS

This application is a U.S. National Stage entry of PCT Application No: PCT/GB2016/052959 filed Sep. 23, 2016, which claims priority to British Patent Application No. 1517085.5, filed Sep. 28, 2015, the contents of which are incorporated herein by reference.

The present invention relates to torches.

The word "torch" as used herein refers to self-contained, electrically powered light sources. It includes small light sources intended to be hand held but also includes light sources which are to be mounted on other structures—for example head torches, helmet lamps, bicycle lamps, and lamps to be carried on clothing or belts. It also includes divers' lights and other light sources for use in aquatic environments.

Conventional torches typically comprise a housing containing an electric battery, a light emitter—e.g. in the form of a filament bulb or light emitting diode (hereinafter "LED"), wiring from the battery to the light emitter, and a user-operable switch to turn the light emitter on and off. The housing needs to have a transparent or translucent window through which light from the emitter emerges. Often the housing is formed from multiple components including a transparent lens or cover for this purpose, and a door or cover for providing access to a battery compartment.

It is desirable that a torch should be robust. In the course of their use torches may be shaken and subject to impacts, e.g. when dropped. They may be exposed to the elements, including rain. Some torches are intended for use in aquatic environments and need to be resistant to ingress of water. Use of LEDs in place of filament bulbs (which are vulnerable to damage by shaking or impacts) is advantageous in this respect, since LEDs can resistant to damage by shaking or impacts to the torch housing, but LED torches often have internal LED driver electronics which can be damaged by rough usage.

Some torches are used in environments where there is a risk of explosions, such as mines, and need to be constructed such that there is a reduced chance of the torch providing a source of ignition. Switches of conventional torches can present a risk due to sparking and consequent ignition of gas, if that gas penetrates the torch housing. High temperature light emitters such as filament bulbs or exposed LEDs may also present a hazard in this respect.

It is also desirable that a torch should be compact. Hand held torches, for example, may be carried on the person, in which case a conveniently pocket-sized unit is highly advantageous. Torches mounted on a bicycle or helmet are preferably small in size and weight, to avoid unnecessary encumbrance. Conventional torch construction can result in an undesirably bulky package.

Constructional simplicity is also highly desirable, not least in order to minimise manufacturing cost. Conventional torches with multi-part housings necessarily involve a degree of constructional complexity.

The present invention is intended to address one or more of these problems.

According to a first aspect of the present invention there is a torch comprising a rechargeable electric battery, at least one LED, an energy receiver device for receiving energy from a charging station, circuitry for charging the battery from the energy receiver device, circuitry for supplying electric current from the battery to the LED to drive the LED, and a user-operable switching device for controlling the supply of current from the battery to the LED, wherein the battery, the LED, the energy receiver device, the circuitry for charging the battery, the circuitry for supplying electric current from the battery to the LED and the switching device are all embedded in a unitary body of polymer material, the LED being arranged to emit light through the polymer material.

The result is a torch which can be robust and tolerant of physical shocks and vibration because its working parts are embedded in and protected by the polymer material. It is simple in construction—the unitary polymer body can be simply formed and needs only one component. Electrical circuitry can be enclosed in the body of polymer material, obviating any risk that sparking will ignite volatile gases in the torch's environment. The polymer material can also serve to distribute and evenly dissipate heat from the torch, avoiding creation of exposed hotspots that might ignite ambient gases.

The energy receiver device needs to be able to receive energy from the charging station and supply electric current to charge the battery. It may be formed as an electrical connector—e.g. a plug or socket. However in the preferred embodiment the energy receiver device comprises a wireless energy receiver which is embedded in and surrounded by the body of polymer material and is adapted to receive energy from an electromagnetic field. It may be an induction device. It may be a magnetic-resonance device. Such devices are known and commercially available for use in charging other devices, in particular smartphones. The wireless energy receiver may comprise an electrically conductive receiver element configured to produce an electro-motive force when subject to a suitable electromagnetic field. The receiver element may comprise a coil. More specifically it may comprise a helical coil on a substrate.

According to a second aspect of the present invention there is a method of manufacture of a torch, comprising providing in a mould the following components:

a rechargeable electric battery, at least one LED, an energy receiver device for receiving energy from a charging station, circuitry for charging the battery from the energy receiver device, circuitry for supplying electric current from the battery to the LED to drive the LED, and a user-operable switching device for controlling the supply of current from the battery to the LED, and introducing mouldable, optically transmissive polymer material into the mould which sets to form around the aforesaid components a unitary body of polymer material in which the components are embedded.

According to a third aspect of the present invention there is a torch adapted to be controlled through a digital wireless interface. The torch may be adapted to interface to one or more similarly formed torches. In this way torches can be daisy-chained. Multiple such torches may be controlled in a coordinated manner. For example they may be arranged to illuminate in sequence to provide a sweep of light along a sequence of torches. They may be used to form a display screen. The torch may be controlled from a digital device.

A specific embodiment of the present invention will now be described, by way of example only, with reference to the accompanying drawings, in which:—

Figure 6:
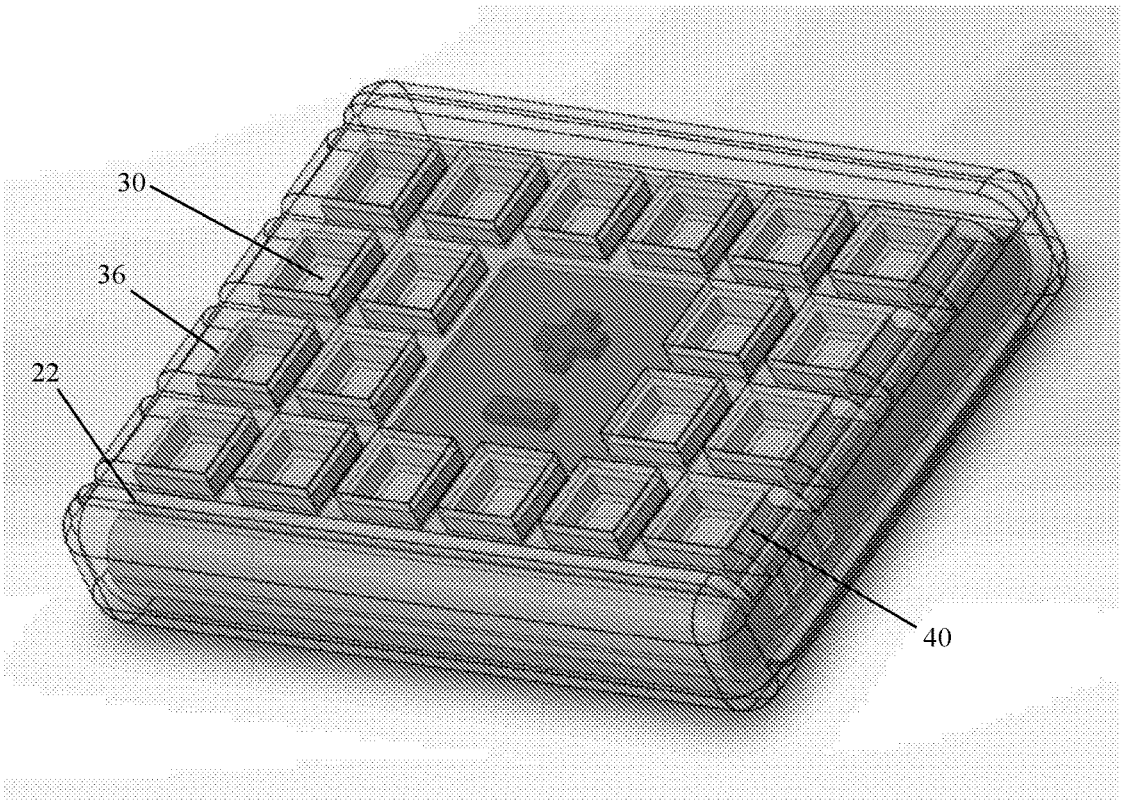
FIG. 6 is a view of a third torch embodying the present invention from above.
Figure 7:
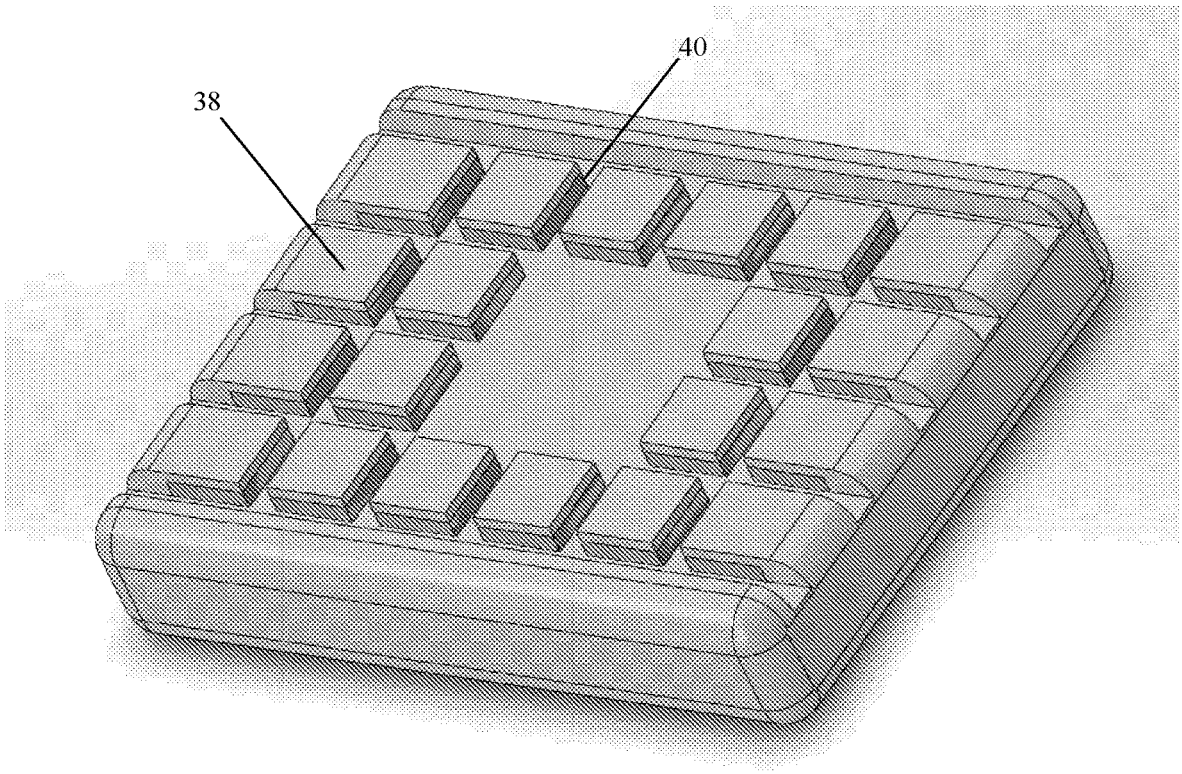
Figure 8:
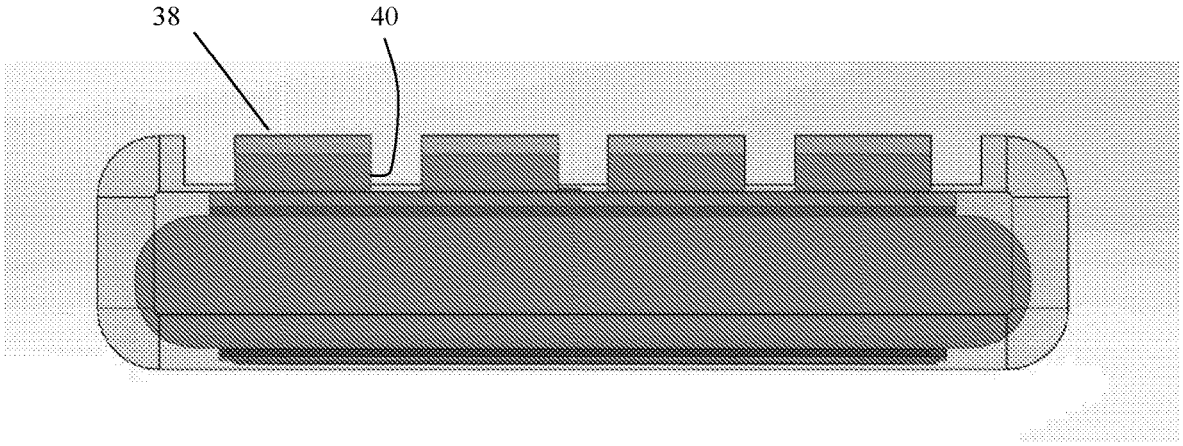

FIG. 7 corresponds to FIG. 6 except that in FIG. 7 certain internal detail is obscured by outer surfaces of the torch; and FIG. 8 is a section through the third torch embodying the present invention.

The torch 10 depicted in FIGS. 1 to 4 is a small, thin and highly portable unit well suited to being carried on the person. It may for example be placed in a wallet, purse, breast pocket or trouser pocket without difficulty. It has no user-serviceable parts and in fact all its interior workings are embedded in and protected by a sealed, unitary polymer body 12. The polymer body 12 forms an enclosure for the torch and substitutes for a conventional hollow housing. The unit is thus entirely waterproof and is extremely well suited to use in aquatic environments. There are no external connectors or switches and no need for such parts to be provided with any seal, other than the polymer body 12 itself. A user-operable switch 14 controls the torch and is operable from its exterior. A wireless energy receiver 16 serves to charge a battery 18 without needing to be plugged into a charger, or for any conductive electrical connection to the unit's exterior. The result is a very compact, rugged and simple torch with a multitude of advantages and possible applications.

Looking at the components of the torch 10 in more detail, the battery 18 is in this example an item developed for use in a mobile telephone (cell phone). Note that the term "battery" is adopted herein in accordance with common usage to refer to an electrical cell or cells—the item in question may have a single electrical cell or multiple cells. More than one battery may be used in other embodiments. Any suitable battery technology may be adopted but the illustrated example is of lithium-ion type. It is thin—i.e. of small depth in relation to its width and height—and generally rectangular in plan. Mobile telephone batteries typically have a protective exterior shell but in the illustrated embodiment a protective sleeve 20 is placed around the battery 18 to provide it with additional protection against physical damage or penetration by a foreign body. The illustrated sleeve 20 is a unitary metal component. Suitable plastics or ceramic materials may be substituted. It may be dispensed with in other embodiments of the invention.

Beneath the battery 18 is the wireless energy receiver 16, through which energy is transferred from a separate charging station 24 to the electrics of the torch 10, in order to charge the battery 18. Because the energy receiver 16 is wireless it can be—and it is—entirely contained within the polymer body 12. There is no need for any externally accessible conductive electrical connector such as a plug or socket which could be vulnerable to damage or create a path for ingress of water into the torch 10.

In the present example the wireless energy receiver 16 is adapted to couple inductively to the charging station. It comprises a conductive coil 26 on a planar substrate 28. The charging station 24 creates an alternating electromagnetic field that induces an electro-motive force (EMF) in the wireless receiver coil 26.

More specifically, the illustrated embodiment uses a magnetic-resonance system for power transfer. Magnetic resonance technology, also referred to as resonant-inductive coupling or resonance charging, is known to the skilled person. The conductive coil 26 and its associated components are designed to have a known resonant frequency (natural frequency) and the charging station has a transmitter coil that is driven with an AC signal at that frequency, creating an electromagnetic field which induces an electromotive force in the coil 26 and thereby providing energy transfer to it. This technology is being used commercially in relation to charging of smartphones and is thus known to the skilled person.

A circuit board 22 carries a set of LEDs 30, all of them in this embodiment being mounted on the side of the circuit board facing away from the battery 18. The circuit board 22 also carries the switch 14 and electronic circuitry, to be described below. The circuit board 22, the battery 18 and the wireless energy receiver 16 are all thin, roughly planar items and are arranged in parallel, in a stack, enabling the torch to be thin and compact.

In the illustrated embodiment the LEDs are arranged to emit light directly out of the polymer body 12. In an alternative embodiment (not illustrated), the LED's light may be directed to a reflector in the polymer body 12 and so re-directed to form an output beam. For example the LEDS may face towards the battery and be incident on a slightly concave/convex or indented/embossed surface that would spread/focus/reflect the light appropriately.

Figure 4:
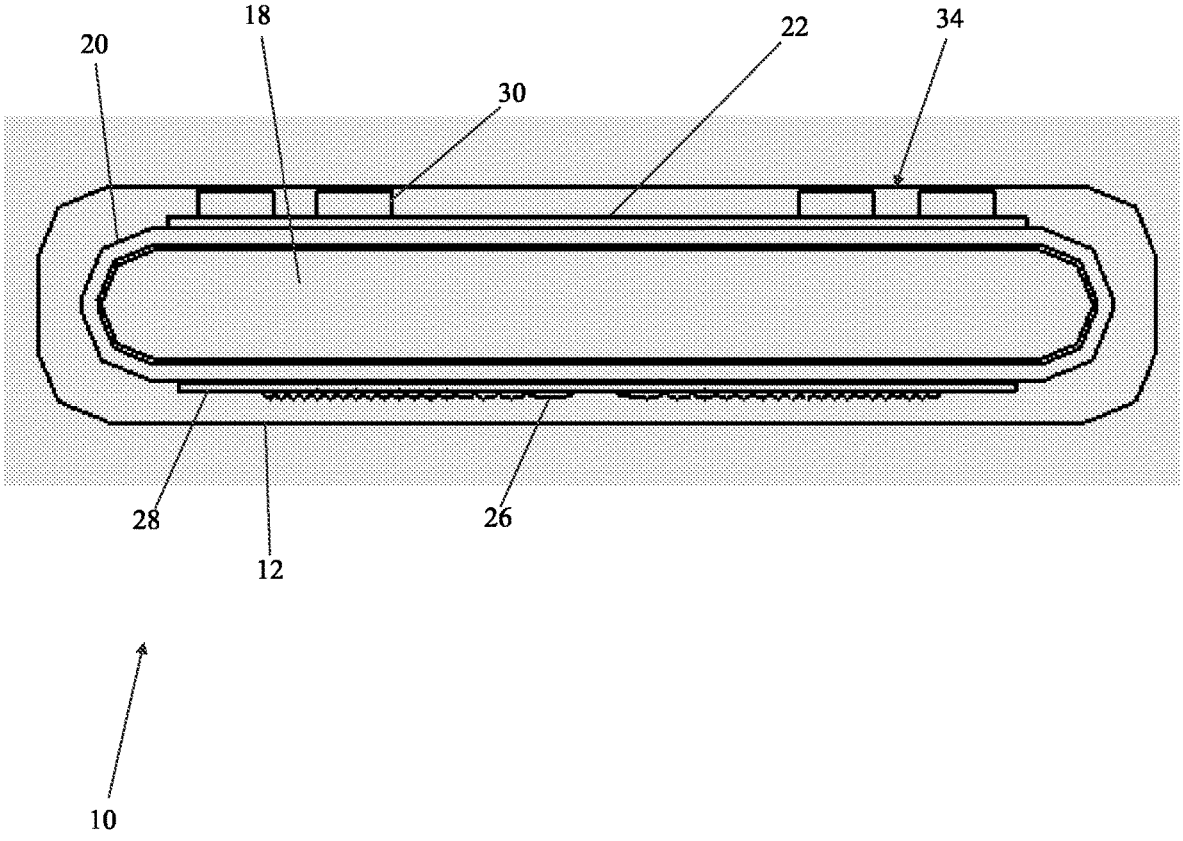
FIG. 4 is a section through a torch embodying the present invention.

The LEDs of the present embodiment emit white light of high intensity. Other light colours could be provided, by choice of a coloured LED and/or by tinting the polymer body 12 through which the light emerges. The number and power of the LEDs can be chosen at the design stage according to requirements as to output intensity etc. The circuit board provides a large area for provision of multiple LEDs, if necessary to achieve a high output light intensity. Note that FIG. 4 shows a smaller number of LEDs than FIGS. 1 to 3.

The user-operable switch 14 can at its simplest toggle between "on" and "off". Alternatively or additionally, provision may be made for the user to i. adjust light output brightness.

ii. step through operating modes such as continuous/flash iii. change the colour of the output light, in embodiments which have LEDs of more than one colour.

The switch 14 may be a pressure operated switch (a push-switch). It is embedded in and surrounded by the polymer body 12, so that the user cannot touch the switch 14 directly, but by pressing on the exterior of the polymer body 12 the user slightly deforms that part, applying pressure through it to the switch 14 within. Alternatively the switch 14 may use any suitable remote sensing technology for detecting proximity of a user's fingertip. For example it may be a capacitive device. Capacitive sensors able to detect proximity of a fingertip are well known in relation to touch screen technology.

Figure 1:
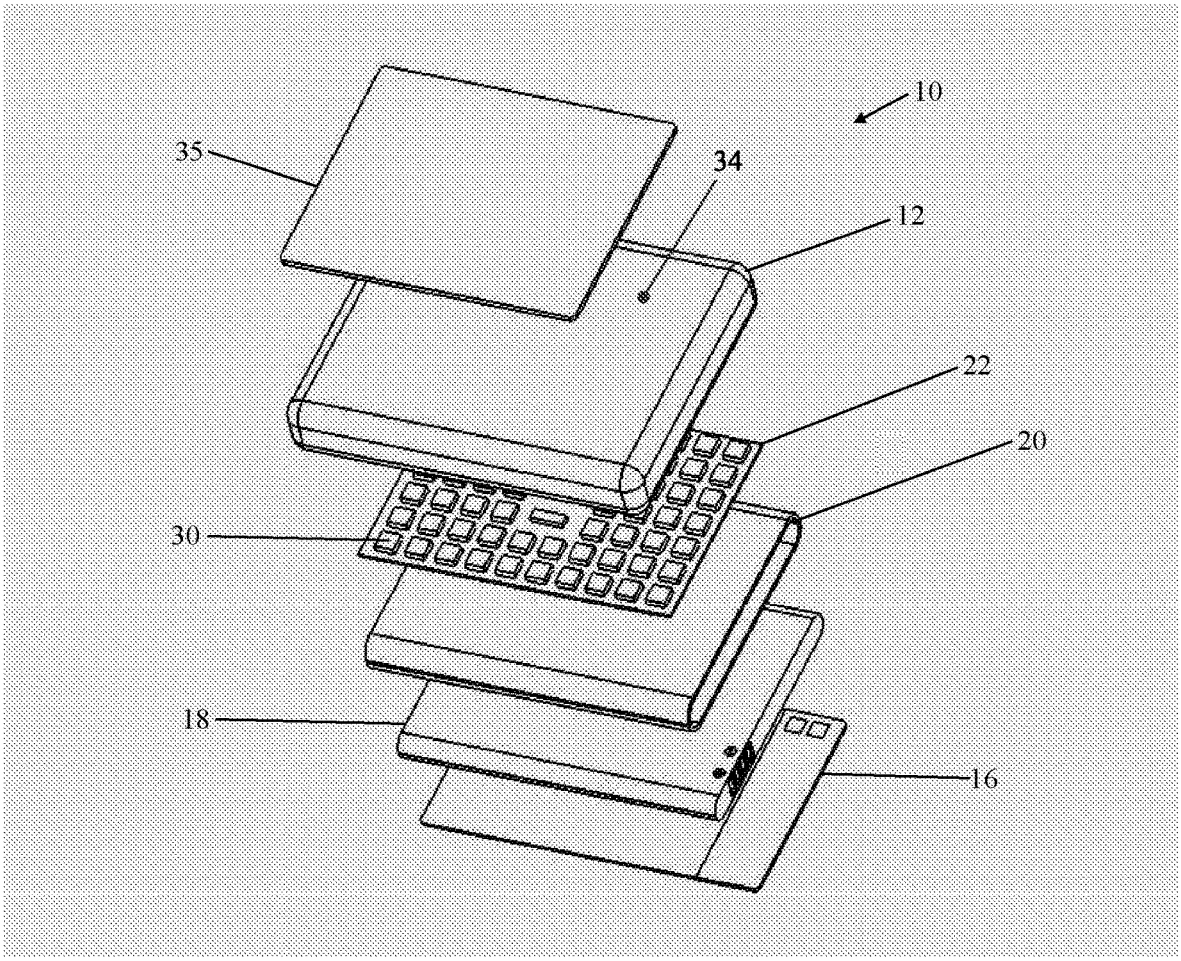
FIG. 1 is an exploded view of the components of a torch embodying the present invention.
Figure 1:
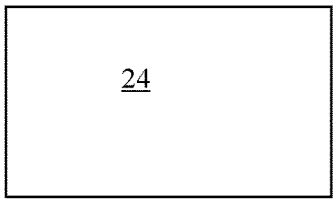
Figure 2:
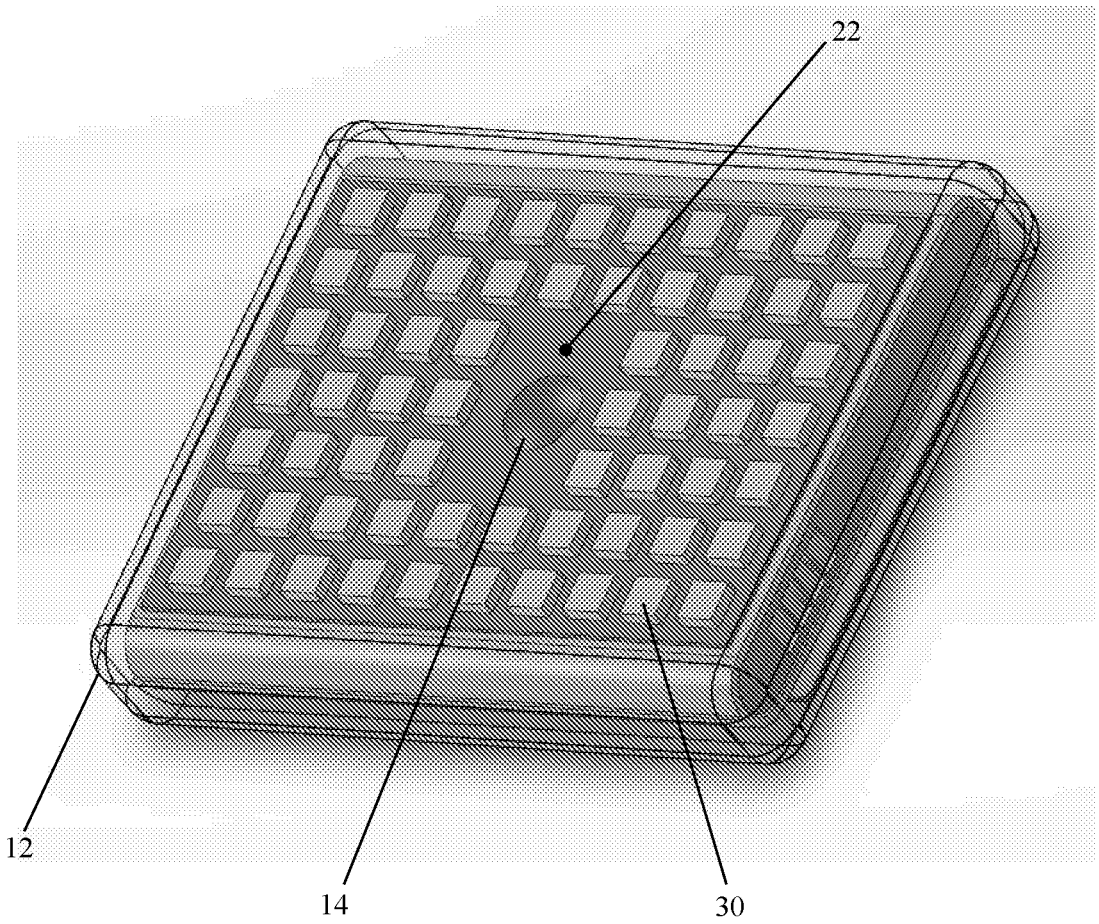
FIG. 2 is a view of the same torch from above.
Figure 3:
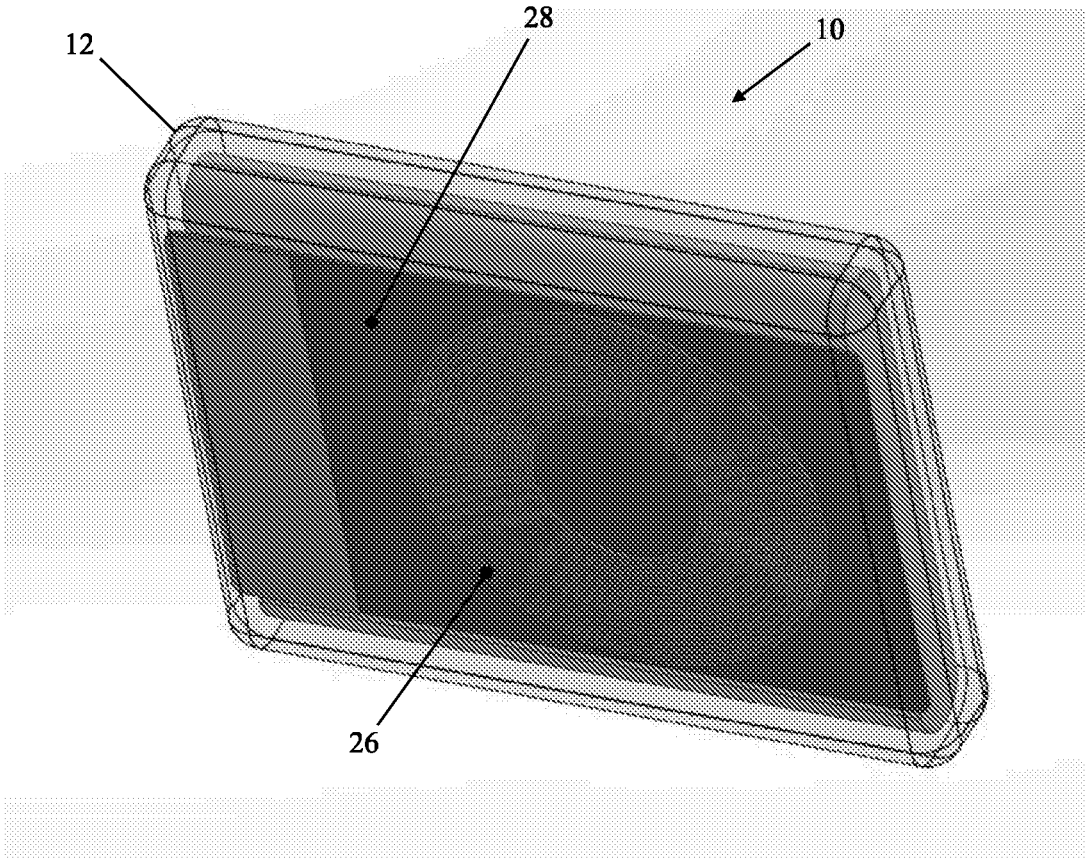
FIG. 3 is a view of the same torch from beneath.

The single switch 14 represented in FIG. 1 may be used to provide both on/off control and adjustment of brightness. For example repeated operation of switch 14 can cause the torch to cycle from "off" through ascending levels of brightness and then—after the brightest setting—back to "off".

Figure 5:
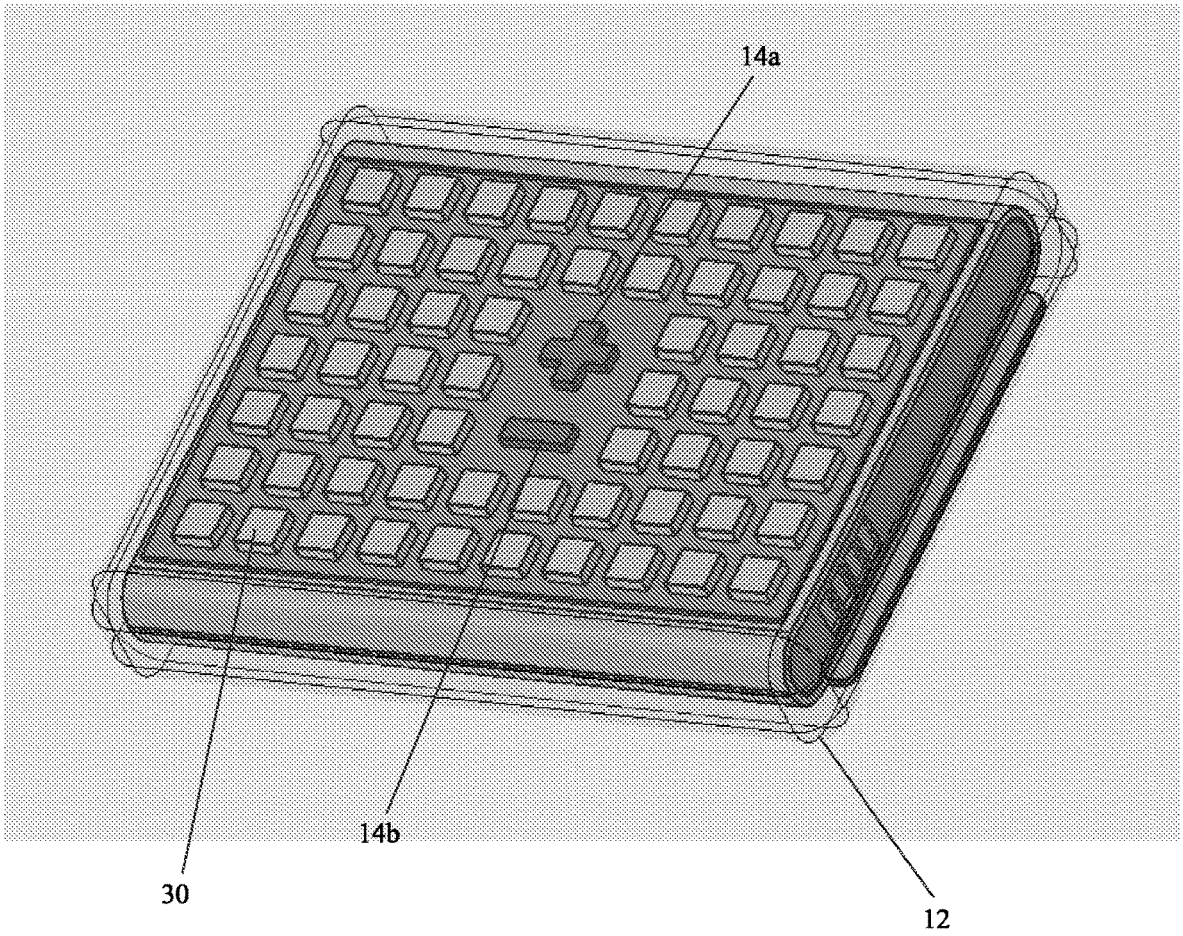
FIG. 5 is a view of a second torch embodying the present invention from above.

Alternatively two switches 14*a*, 14*b* may be provided as in the embodiment depicted in FIG. 5. In this case one switch may toggle between "on" and "off" and the other may control brightness. Another possibility is to have one switch 14*a* operable to incrementally increase brightness and another switch 14*b* operable to incrementally decrease brightness. Repeated operation of the switch 14*b* turns the torch off after it has reached its lowest level of brightness. To stop the torch turning on accidentally whilst in pocket or bag, in certain embodiments both switches must be pressed at the same time, perhaps for a short period of time, around a second, to activate the torch.

The exterior of the polymer body 12 may be shaped to indicate—to the fingertip of the user—where pressure is to be applied to actuate the switch. In the FIG. 5 example the switches 14*a* and 14*b* are respectively shaped as '+' and '-' symbols. The same symbols can be felt when running the finger across the front surface of the torch so that they can be located without looking directly at the lit torch. Also such features of shape make it easier for the user to locate the buttons in the dark.

The polymer body 12 entirely surrounds the other torch components in the illustrated embodiment, so that none of them is accessible to the user. This is feasible because (a) none of the components is intended to be serviced or replaced, all of them having a design lifetime at least equal to that of the torch itself; (b) by use of wireless technology to transfer the energy required to charge the battery, no electrical contact needs to be made to the torch's circuitry and (c) the switch is operable from outside the polymer body 12.

During manufacture the polymer body 12 is moulded around the other torch components. The torch components are placed in a mould, then polymer material in liquid/resinous form is introduced to the mould. The polymer material sets to form the polymer body 12. Hence the torch components are embedded in the polymer material and are in intimate contact with it. The resultant unit can be very robust and very simple in terms of structure and manufacture.

The material of the polymer body 12 may be an elastomer. It may be a potting compound. It is optically transmissive, at least in the region through which light from the LEDs emerges. In the present embodiment it is entirely transparent, so that the torch's internal components are visible to the user, although suitable moulding techniques may be used to form a polymer body 12 which is opaque in some regions and optically transmissive in others. Potting compounds known for use in potting optical components on circuit boards may be used to form the polymer body 12. In the illustrated embodiment the polymer body 12 is formed of silicone. Other suitable materials include polyurethane and rubber.

The torch 10 may further comprise an optical element (not shown) disposed in the path of light emitted by the LEDs to shape the torch's output light pattern, e.g. to provide a more focussed output beam. In a shallow package of the type illustrated, a Fresnel lens is especially suitable for this purpose and may be adopted. The optical element may be:

i. formed by shaped features of the polymer body 12. For example the small prismatic elements making up a Fresnel lens may be formed on outer face 34 of the polymer body 12 during its moulding or by a subsequent embossing or machining process
ii. formed by an additional component (or components) secured to the exterior of the polymer body 12. For example a pre-formed Fresnel lens 35 may be mounted to the outer face 34 as seen in FIG. 1
iii. disposed within the polymer body 12. An optical component (or components) having a refractive index sufficiently different from that of the polymer body 12 can be incorporated within it and serve to shape the output beam
iv. clipped onto the front of the torch. The lens could be part of a clip used to attach the torch to a helmet or to a bicycle, in which case in use the torch could be placed into its holder and the lens slid or swung in front of the light emitting face
v. arranged so that the LEDS face inward and a reflective surface disperses the light accordingly (as mentioned elsewhere herein).

In the embodiments illustrated in FIGS. 1 to 5 heat generated by the LEDs 30 is dissipated by conduction through the polymer body 12, and by emission through and from it. This is sufficient in some embodiments. In other cases it may be necessary to provide for sinking of heat from the LEDs. FIGS. 6 to 8 illustrate a further torch embodying the present invention in which the LEDs 30 on circuit board 22 are provided with heat sinks 36. In this example each LED 30 is provided with a respective heat sink 36, although in other embodiments one heat sink can serve more than one LED. The heat sinks 36 take the form of shallow trays. They may comprise metal. More specifically they may comprise an aluminium alloy. Each heat sink is covered by a region 38 of the polymer material, and in this embodiment the polymer body 12 is shaped to define these regions and to expose to the exterior radiator faces 40 of the heat sinks 36 through which heat is dissipated to the surroundings, whilst keeping the top surfaces of the heat sink coated in the polymer so they are not exposed to the user and as such the user does not touch the hot heat sink surfaces when handling the torch. It may also be beneficial to groove the polymer's outer surface without the heatsink in order to increase the exposed surface area to its external environment which could also promote cooling.

The features of the torches described herein work together to provide important advantages. Conventionally, torches have a housing which can in some manner be opened to provide the user with access to interior components, enabling replacement of a non-rechargeable battery and/or of a filament bulb. In connection with the torch 10 it is not necessary to provide user access to any of the working components. Because the battery 18 is rechargeable it does not require replacement. The LEDs 30 have a long enough design lifetime that it is not necessary to provide for their replacement either. This makes it possible to permanently encase all the working components in the polymer body 12 and so provide them with highly effective protection against physical damage due to impacts etc. The relatively modest emission of heat by the LEDs 30 ensures that the polymer body does not suffer from heat damage in use, despite being in intimate contact with the LED. The use of a wireless energy receiver avoids any need to make electrical connections with the battery components to provide for battery charging, avoiding any need for an external connector such as a socket, which again contributes in making the torch 10 water resistant and robust.

The charging station 24 can take a number of different forms. Wireless charging stations are already commercially available for use with mobile devices such as smartphones, and the torch 10 may be configured to be charged by one of these. Various known charging stations take the form of a shallow mat upon which the device to be charged is placed, and the form of the torch 10 makes it well suited to use with chargers of this type, although magnetic resonance energy transfer makes it possible to transmit the necessary energy over an appreciable spatial separation between the charging station and the battery 10.

Additionally or alternatively the torch may be controlled wirelessly. This may be via Bluetooth®, WIFI or other wireless information technology.

The torch may be wirelessly controlled from a separate digital device such as a smart phone, laptop, tablet, wearable digital device or other type of computer. This can give the torch a greater range of functions. For example, if multicolour LEDS are used in the torch, the torch could link with some music software and change its display in real-time and in time with the music playing. Wireless control of the torch would also give the option to turn individual LEDs on or off selectively. Under control of a digital device, the torch may be used as a signalling device. For example an application running on the digital device may translate words, which may be typed on or spoken to the device, into a binary signal language such as Morse code. Through a link with Facebook®, Twitter® or other social media, the torch may be controlled such that its colour output and/or intensity reflect the status that the user has publicly stated.

The torch may be in the form of a fob for mounting on a key ring, in which case it may serve as a key-finder if paired with a digital device such as a mobile phone, being turned on in response to a user request to make the keys visible to the seeker. Whilst it is understood that audible keyfinders are available, this version would be especially beneficial for the visually impaired or deaf.

Multiple torches embodying the present invention could also "daisy-chain" and synchronise their output so that a light pattern scrolled across them, creating a light show. This would be particularly useful for temporary lighting at garden parties or swimming pool lighting. One extreme example of synchronising the torches would be to make a form of screen where each of the LEDs would act as a pixel. However, it is envisaged that a backing board would be provided in this application which contained wireless chargers to ensure the screen could remain intact once assembled. The backing board may also help in the coordination of the different torches.

Another simpler example of daisy-chaining would be to use torches embodying the present invention on traffic cones to provide a cascading sweep of light travelling down the line of cones. Another simpler example of daisy chaining is an emergency runway in the dark for the army. They could coordinate the flashing to help guide the pilot in.

The torch can be given GPS capability so that the torch is able to know its location. This gives the torch further functionality and also enables it to be easily located by a phone or similarly paired device. It can then also be used in, for example, games. An example of this game would be where the lights change colour or brightness depending on the vicinity of other torches. If the other player gets too close then the torch goes off and you lose.

The invention claimed is:

1. A torch comprising
- a rechargeable electric battery,
- at least one LED,
- a wireless energy receiver device for receiving energy from a charging station,
- circuitry for charging the battery from the wireless energy receiver device,
- circuitry for supplying electric current from the battery to the LED to drive the LED, and
- a user-operable switching device for controlling the supply of current from the battery to the LED,
- wherein the battery, the LED, the circuitry for charging the battery, the circuitry for supplying electric current from the battery to the LED and the switching device are all embedded in a unitary body of polymer material, the LED being arranged to emit light through the polymer material.

2. A torch as claimed in claim 1 in which the wireless energy receiver device is embedded in and surrounded by the body of polymer material and is adapted to receive energy from an electromagnetic field.

3. A torch as claimed in claim 2 in which the wireless energy receiver is a magnetic-resonance device.

4. A torch as claimed in claim 2 in which the wireless energy receiver comprises an electrically conductive receiver element configured to produce an electro-motive force when subject to a suitable electromagnetic field.

5. A torch as claimed in claim 4 in which the receiver element comprises a helical coil on a substrate.

6. A torch as claimed in claim 1 in which the unitary body of polymer material comprises potting material.

7. A torch as claimed in claim 1 in which the unitary body of polymer material comprises silicone, polyurethane or rubber.

8. A torch as claimed in claim 1 in which the unitary body of polymer material is moulded around the other battery components.

9. A torch as claimed in claim 1 in which the LED and some or all of the circuitry is disposed upon a circuit board, the wireless energy receiver device and the circuit board being arranged in a stack within the unitary body of polymer material.

10. A torch as claimed in claim 1 in which the switching device is a pressure operated switch arranged to be pressed through the polymer material.

11. A torch as claimed in claim 1 in which the switching device is a capacitive device.

12. A torch as claimed in claim 1 further comprising an optical element in the form of a Fresnel prism formed and arranged to shape a light beam emerging from the torch.

13. A torch as claimed in claim 12 in which the optical element is formed by features of the exterior shape of the body of polymer material.

14. A torch as claimed in claim 12 in which the optical element is secured to the exterior of the body of polymer material.

15. A torch as claimed in claim 12 in which the optical element is embedded in and surrounded by the body of polymer material.

16. A torch as claimed in claim 1 which is controllable through a wireless interface.

17. A method of manufacture of a torch, comprising
- providing in a mould the following components:
  - a rechargeable electric battery,
  - at least one LED,
  - an energy receiver device for receiving energy from a charging station,
  - circuitry for charging the battery from the energy receiver device,
  - circuitry for supplying electric current from the battery to the LED to drive the LED, and
  - a user-operable switching device for controlling the supply of current from the battery to the LED,
- and introducing mouldable, optically transmissive polymer material into the mould which sets to form around the aforesaid components a unitary body of polymer material in which the components are embedded.

18. A method as claimed in claim 17 in which all of the said components are surrounded entirely by the polymer material.

19. A method as claimed in claim 17 in which the energy receiver device comprises a wireless energy receiver which is embedded in and surrounded by the body of polymer material and is adapted to receive energy from an electromagnetic field.

20. A method as claimed in claim 17 in which the mould is shaped to form, on the exterior of the body of polymer material, an optical element for shaping a light beam that emerges from the torch in use.

* * * * *